US008920117B2

(12) United States Patent
Bouchard et al.

(10) Patent No.: US 8,920,117 B2
(45) Date of Patent: Dec. 30, 2014

(54) FABRICATED GAS TURBINE DUCT

(75) Inventors: Richard Bouchard, Sorel-Tracy (CA); Douglas MacCaul, Varennes (CA); Daniel Trottier, Calixa-Lavallee (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 588 days.

(21) Appl. No.: 13/267,956

(22) Filed: Oct. 7, 2011

(65) Prior Publication Data

US 2013/0089416 A1 Apr. 11, 2013

(51) Int. Cl.
*F01D 25/24* (2006.01)
*F01D 25/16* (2006.01)

(52) U.S. Cl.
CPC ..... *F01D 25/246* (2013.01); *F01D 25/162* (2013.01)
USPC ..... 415/209.4; 415/210.1

(58) Field of Classification Search
USPC ..... 415/198.1, 209.2, 209.3, 209.4, 210.1
See application file for complete search history.

(56) References Cited

U.S. PATENT DOCUMENTS

| | | | | | |
|---|---|---|---|---|---|
| 2,924,425 | A * | 2/1960 | Cutler | 415/209.4 |
| 3,393,436 | A * | 7/1968 | Blackhurst et al. | 29/889.22 |
| 3,588,267 | A * | 6/1971 | Wilkinson | 15/135 |
| 3,778,185 | A * | 12/1973 | Plowman et al. | 415/209.4 |
| 4,639,189 | A | 1/1987 | Rosman | |
| 4,704,066 | A * | 11/1987 | Weissbacher | 415/191 |
| 5,083,900 | A * | 1/1992 | Carletti et al. | 415/209.3 |
| 5,332,360 | A | 7/1994 | Correia et al. | |
| 5,609,467 | A * | 3/1997 | Lenhart et al. | 415/142 |
| 5,797,725 | A | 8/1998 | Rhodes | |
| 6,416,278 | B1 * | 7/2002 | Caddell et al. | 415/191 |
| 6,543,998 | B1 * | 4/2003 | Scharl | 415/209.3 |
| 6,558,115 | B2 | 5/2003 | Tiemann | |
| 6,648,597 | B1 * | 11/2003 | Widrig et al. | 415/200 |
| 6,887,040 | B2 | 5/2005 | Tiemann et al. | |
| 6,921,246 | B2 | 7/2005 | Brainch et al. | |
| 7,100,358 | B2 * | 9/2006 | Gekht et al. | 60/39.5 |
| 7,147,434 | B2 * | 12/2006 | Mons et al. | 415/200 |
| 7,413,400 | B2 * | 8/2008 | Barnett | 415/119 |
| 7,434,383 | B2 * | 10/2008 | Vintilescu et al. | 60/226.1 |
| 7,637,718 | B2 * | 12/2009 | Barnett et al. | 415/119 |
| 7,762,761 | B2 | 7/2010 | Busch et al. | |
| 7,798,775 | B2 | 9/2010 | Kammel et al. | |
| 2010/0054932 | A1 * | 3/2010 | Schiavo | 415/200 |
| 2010/0275614 | A1 * | 11/2010 | Fontaine et al. | 60/797 |
| 2011/0036068 | A1 * | 2/2011 | Lefebvre et al. | 60/262 |
| 2011/0081240 | A1 * | 4/2011 | Durocher et al. | 415/209.3 |

* cited by examiner

*Primary Examiner* — Edward Look
*Assistant Examiner* — Wayne A Lambert
(74) *Attorney, Agent, or Firm* — Norton Rose Fulbright Canada LLP

(57) ABSTRACT

A vane structure of a gas turbine engine includes a plurality of vanes extending radially between outer and inner shrouds. At least the outer shroud is formed substantially from a single-piece annular skin of sheet metal. A plurality of reinforcing plates are placed against and are affixed to an outer surface of the skin of the outer shroud in respective joining locations where a radial outer end of each of the respective vanes joins the skin.

8 Claims, 4 Drawing Sheets

FABRICATED GAS TURBINE DUCT

TECHNICAL FIELD

The described subject matter relates generally to gas turbine engines, and more particularly to fabricated gas turbine ducts.

BACKGROUND OF THE ART

Gas turbine ducts exposed to elevated temperatures in operation must face differential thermal expansions. For example, where airfoils span the duct, the airfoil may be exposed to the hot gas flow which causes it to expand radially. However, the airfoil is radially restrained between the two rings of the respective inner and outer walls which are cooler than the airfoil because the inner and outer annular walls are protected somewhat by the developed boundary layers of the hot gas flow and may be further cooled by external and secondary airflows. This results in a thermal mismatch which may generate stress on the adjoining areas of the outer and inner annular walls. There is a need to provide an alternative vane structure of a gas turbine engine for elevated temperature operation.

SUMMARY

In one aspect, the described subject matter provides a gas turbine engine vane structure comprising: an annular duct defined between outer and inner shrouds, at least the outer shroud including a single-piece annular skin of sheet metal, the skin having an inner surface exposed to the duct and an outer surface surrounding the duct; a plurality of circumferentially spaced vanes extending from the inner shroud radially outwardly to a radial outer end which is affixed to the inner surface of the skin by one of welding and brazing; and a plate affixed by one of welding and brazing to the outer surface of the skin at a location corresponding to each vane, the plate having an outer periphery which extends at least on one direction beyond an outer periphery of the respective vane.

In another aspect, the described subject matter provides a gas turbine engine vane structure comprising: an outer shroud and an inner shroud disposed within the outer shroud to define an annular duct extending radially between the outer and inner shrouds, the outer and inner shrouds including a single-piece annular skin of sheet metal, respectively, each of the skins having opposed outer and inner surfaces, the inner surfaces of the respective skins facing each other; a plurality of circumferentially spaced hollow vanes, each vane extending radially through the annular duct, each hollow vane terminating with a radial inner end on the skin of the inner shroud and terminating with a radial outer end on the skin of the outer shroud, the radial inner and outer ends of each vane being affixed to the skins of the respective inner and outer shrouds by welding or brazing, each of the hollow vanes being in fluid communication with an opening defined in the skin of the respective inner and outer shroud; and a plurality of members having a contacting surface greater than or equal to other individual surfaces of the member, the contacting surface of the members being attached by welding or brazing to the outer surface of the skin of the outer shroud, the contacting surface of each member abutting the skin at a location in which the radial outer end of one of the hollow vanes joins the skin.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

It will be noted that throughout the appended drawings, like features are identified by like reference numerals.

DETAILED DESCRIPTION

Figure 1:
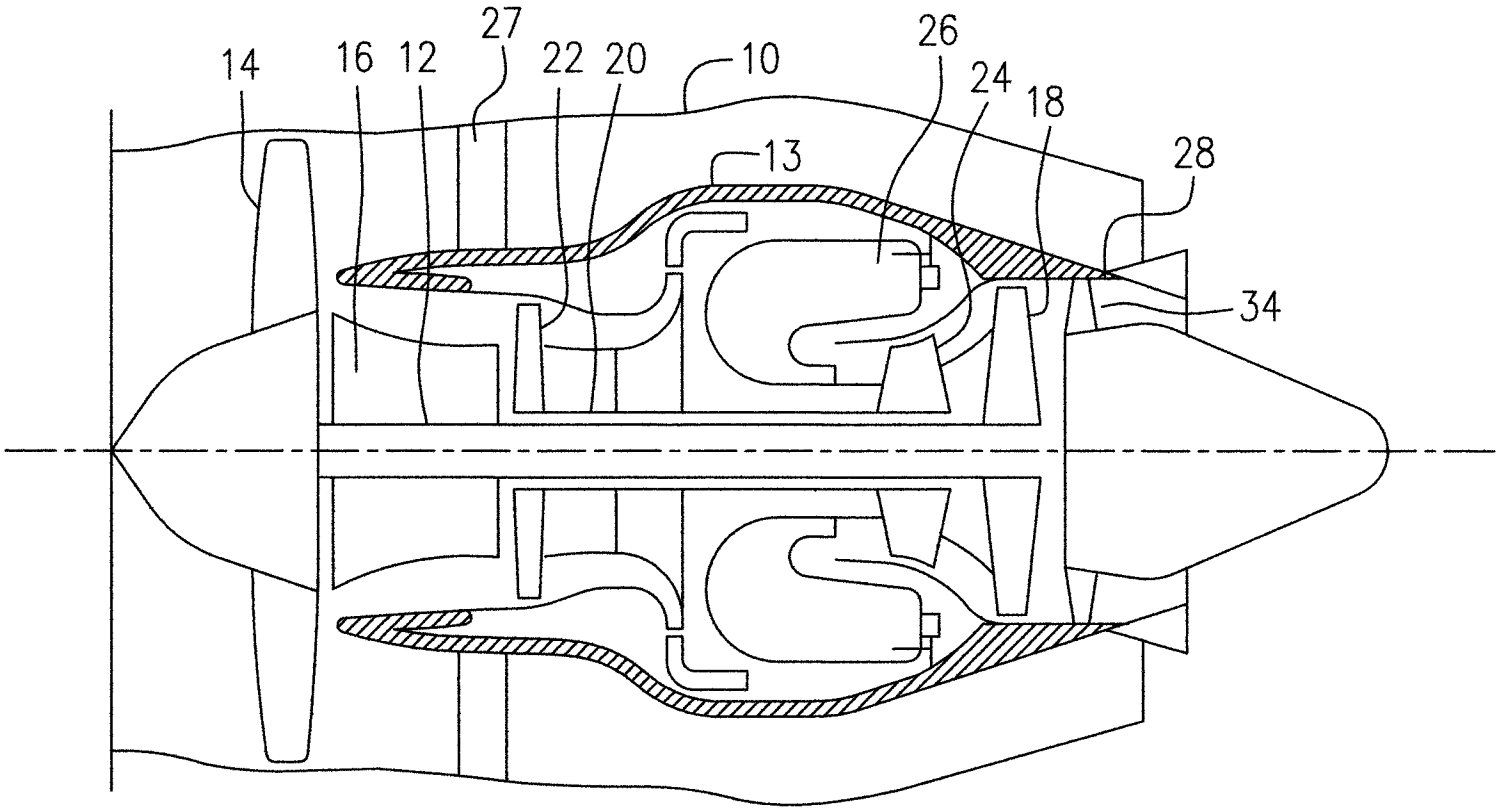
FIG. 1 is a schematic cross-sectional view of a turbofan gas turbine engine as an example illustrating an application of the described subject matter.

FIG. 1 illustrates a gas turbine engine as an example of the application of the described subject matter which includes a housing or nacelle 10, a core casing 13, a low pressure spool assembly seen generally at 12 which includes a fan assembly 14, a low pressure compressor assembly 16 and a low pressure turbine assembly 18 and a high pressure spool assembly seen generally at 20 which includes a high pressure compressor assembly 22 and a high pressure turbine assembly 24. The core casing 13 surrounds the low and high pressure spool assemblies 12 and 20 in order to define a main fluid path (not numbered) therethrough including a combustor 26. The main fluid path of the engine includes static fluid path structure which may be primarily made of welded sheet metal components, such as a fabricated turbine exhaust case 28.

Referring to FIGS. 1-6, the turbine exhaust case 28 as an example of the described subject matter, includes an annular outer shroud 30 and an inner shroud 32 disposed within the outer shroud 30 to define an annular duct 34 radially between the outer and inner shrouds 30, 32. A plurality of circumferentially spaced struts or vanes 36 (the term "vane" is used generically herein to refer to both vanes and struts) are provided within and span the annular duct 34, and radially extend between the outer and inner shrouds 30, 32, thereby structurally connecting same. A mounting flange 38 may be provided, affixed for example by welding to the outer shroud 30 at the front end thereof, for securing the turbine exhaust case 28 to an engine case, such as the core casing 13 which is in turn structurally connected to the nacelle 10 through a plurality of radially extending struts 27. The inner shroud 32 may be connected to a bearing assembly (not shown) for supporting an aft end of a main shaft of the low pressure spool assembly 12. Optionally, a mixer 40 may be attached to the aft end of the outer shroud 30.

The outer shroud 30 according to one embodiment, may include a single-piece annular skin 42 of sheet metal to define a continuous ring (not numbered). In this description and the appended claims, "single-piece annular skin" refers to the fact that the sheet metal skin is configured to provide an unsegmented, continuous ring around its circumference. As such, a simple, lightweight shroud is provided relative to segmented ring configurations, for example. Segmented rings may allow for differential expansion to accommodate thermal mismatch, but tend to be heavier (i.e. additional flanges, etc.) and may be weaker (i.e. discontinuities).

According to one embodiment, each of the hollow vanes 36 may be formed from sheet metal in a hollow airfoil configuration, and may extend radially and outwardly from the inner shroud 32 and terminate with a radial outer end (not numbered) on the skin 42 of the outer shroud 30. (Although described here as being hollow, the vanes 36 may have any suitable configuration, and need not be hollow or as described). The radial outer end of the vanes 36 are affixed to the skin 42 by welding or brazing at respective locations of the skin 42. In each of such locations, a joining area 44 is defined by a continuous joining line 46 between the skin 42 and the radial outer end of the respective vanes 36, as indicated by broken lines in FIG. 3 and as exaggeratedly illustrated in cross-section in FIGS. 5 and 6.

During engine operation, the respective vanes 36 are exposed to hot gases flowing from the low pressure turbine assembly 18 and passing through the annular duct 34. Under such an elevated temperature condition, the respective vanes 36 tend to expand radially. However, the radial expansion tendency of the respective vanes 36 is restrained by the respective outer and inner shrouds 30, 32 which are cooler because they are protected somewhat by the developed boundary layers of the hot gas passing through the annular duct 34 and may be further cooled by external and secondary cooling flows. These different thermal conditions affecting the vanes 36 and the outer and inner shrouds 30, 32, respectively, generate high levels of stresses, generally distributed around the respective joining areas 44 of the skin 42 of the outer shroud 30, and around joining areas on the inner shroud 32. Stress concentration is normally located at the leading edge corners and trailing edge corners of the respective vanes 36, as indicated by the circled areas 48*a*, 48*b*, 48*c*, 48*d* in FIG. 2.

Figure 3:
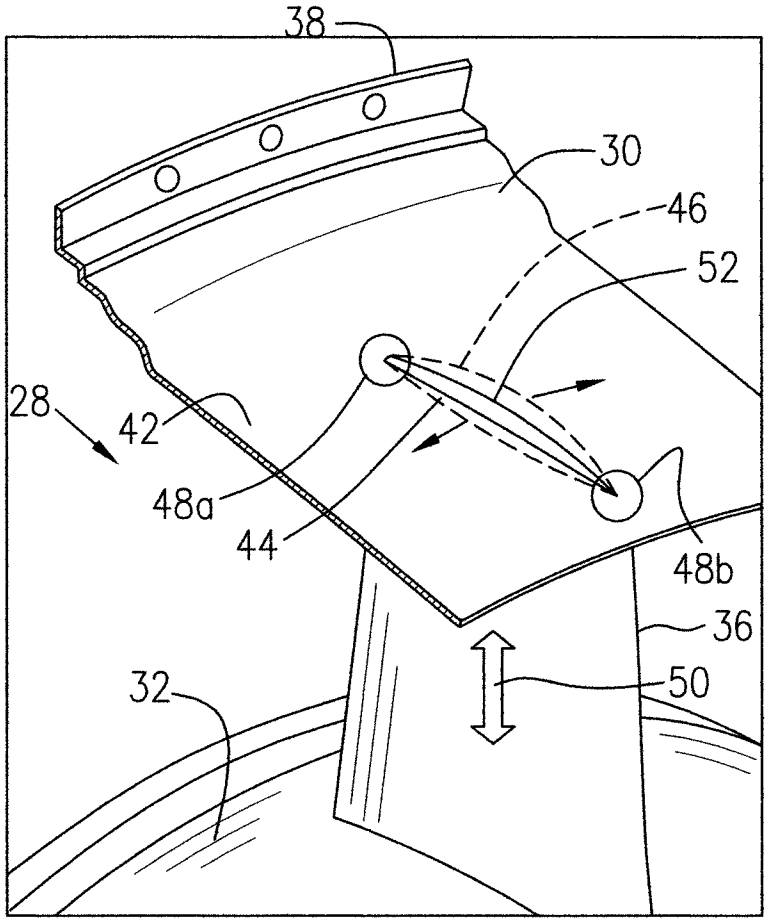
FIG. 3 is a partial perspective view of the fabricated turbine exhaust case of FIG. 2, with the reinforcing member removed, illustrating an opening defined in the outer shroud in a joining location where one of the vanes joins the outer shroud.

It has been found that the skin 42 of the outer shroud 30 tends to be stretched locally at each joining area 44, as shown by a pair of oppositely directed arrows in FIG. 3, resulting from the radial expansion tendency (indicated by arrow 50) of each vane 36. In particular, in some gas turbine vane structures, an opening 52 which may have a profile similar to the airfoil profile of the vane 36, is provided in each joining area 44 of the skin 42 of the outer shroud 30. The opening 52 provides fluid communication with the hollow vane 36, for example to allow secondary air flow to pass through the hollow vane 36. The circumferential local stretching tendency at the joining area 44 of the skin 42, may thus tend to tear the opening 52 more widely, which may amplify the stress concentrations at the leading and trailing edge corners 48*a*, 48*b*.

Figure 6:
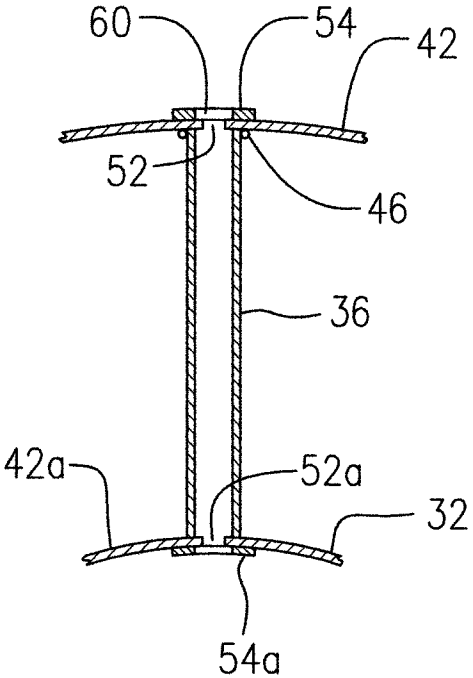
FIG. 6 is a partial cross-sectional view of the fabricated turbine exhaust case taken along line 6-6 in FIG. 4.
Figure 5:
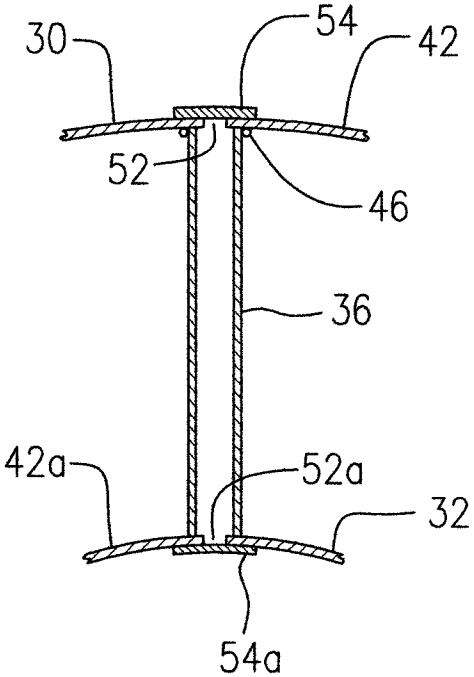
FIG. 5 is a partial cross-sectional view of the fabricated turbine exhaust case, taken along line 5-5 in FIG. 4.

According to the described embodiment, the inner shroud 32 may include a annular skin 42*a* of sheet metal (see FIGS. 5 and 6). Each of the vanes 36 extends radially across the annular duct 34 and terminates with a radial inner end (not numbered) on the skin 42*a* of the inner shroud 32. The radial inner end of each vane 36 may be affixed to the skin of the inner shroud 32 by welding or brazing. The skin of the inner shroud may be provided with respective openings 52*a* in fluid communication with the respective hollow vanes 36, similar to the openings 52 in the skin 42 of the outer shroud 30. Alternately, the inner shroud 32 may be configured in any other suitable manner, such as being cast, and the radial inner end of the vanes 36 may be connected in any suitable manner to the inner shroud 32. Each of the hollow vanes 36 according to one embodiment, may be also formed from sheet metal in a hollow airfoil configuration. Alternatively, the respective hollow vanes 36 may be formed otherwise, such as in a cast process.

According to one embodiment, a plurality of reinforcing members, such as reinforcing plates 54 may be provided. The reinforcing plates 54 are welded or brazed to an outer surface of the skin 42 of the outer shroud 30 to correspond with the vane connection locations on the shroud. The connection locations are substantially located at the joining areas 44 on the skin 42 of the outer shroud 30. The outer surface of the skin 42 is the "cold" side of the skin 42, opposite to an inner surface which is the "hot" side of the skin 42.

The reinforcing plates 54 according to one embodiment, have a contacting surface (not numbered) which abuts the outer surface of the skin 42. The contacting surface is defined within a continuous outer periphery 56 which defines a dimension of the plate 54 substantially in a circumferential direction of the outer shroud 30. In order to reduce the overall stresses and move the peak stresses away from the vane corners (leading and trailing edges), the plate 54 will extend beyond the vane footprint to reach further than the vane's fillet weld connection with the shroud. Hence, the width of the outer periphery 56 is greater than a width of the joining area 44 (as shown in FIG. 3), that is, a width defined between weld fillets at suction and pressure sides of the radial outer end of the respective vanes 36. The length of the outer periphery 56 which is the length of the contacting surface, is also greater than a length between the vane fillets at leading and trailing edges of the radial outer end of the vane. The contacting surface according to one embodiment, may be a main surface of the plate which may have a dimension greater than or equal to dimensions of other individual surfaces of the reinforcing plate 54. The contacting surface is defined within the outer periphery 56 of the reinforcing plates 54.

Figure 4:
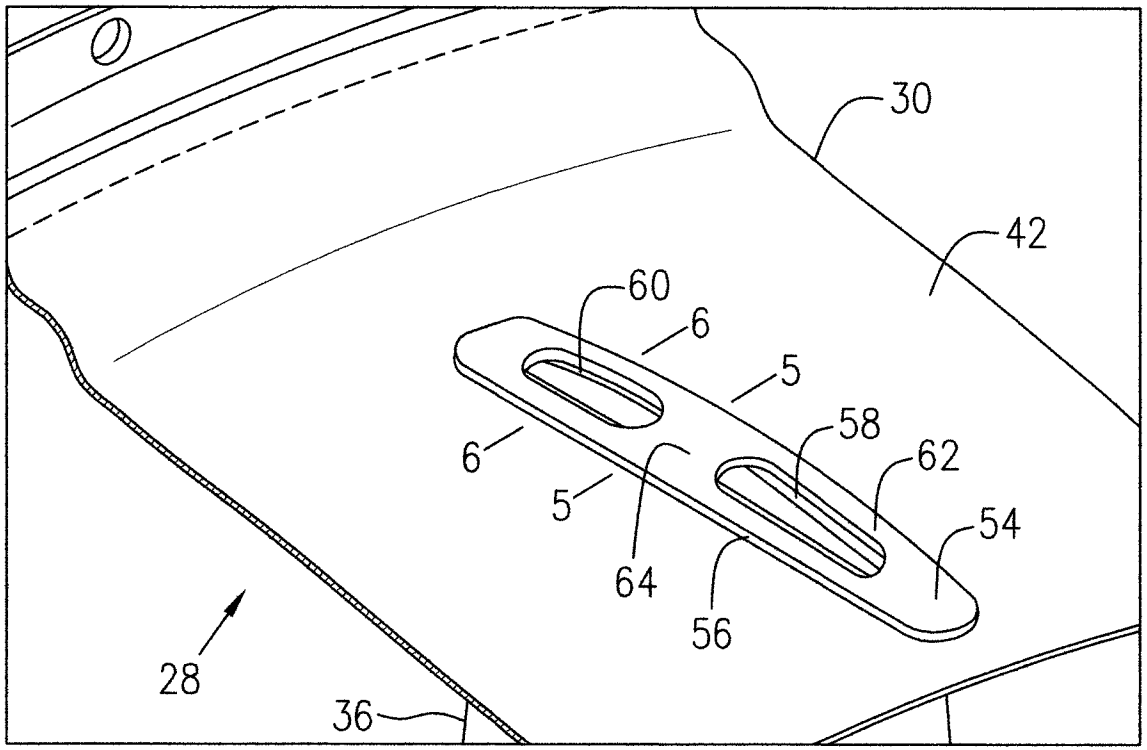
FIG. 4 is a partial perspective view of the fabricated turbine exhaust case of FIG. 2, showing the reinforcing member as a patch attached to the outer shroud in the joining location.

Each of the reinforcing plates 54 may define at least one opening extending therethrough allowing fluid communication with the hollow vane 36 through the opening 52 defined in the skin 42 of the outer shroud 30. For example, as illustrated in FIG. 4, two openings 58 and 60 are provided in each of the plates 54. The openings 58, 60 are surrounded by a continuous peripheral portion 62 and are spaced by a middle portion 64 of the plate 54. The two openings 58 and 60 are in fluid communication with the hollow vane 36 which joining the skin 42 of the outer shroud 30 in the location where the reinforcing plate 54 is attached, through the opening 52 defined in the skin 42 in the same location. The peripheral portion 62 stiffens the skin 42 in the joining location 44 along the joining line 46. The middle portion 64 functions as a stiffening bridge to connect portions of the skin 42 at the respective opposite sides of the opening 52 in the skin 42. The two portions join the respective suction and pressure sides of the hollow vane 36. Therefore, the middle portion 64 of the plate 54 prevents the two portions of the skin 42 at the respective opposite sides of the opening 52, from moving away from one another, which significantly reduces peak stress levels and thus effectively relieves amplification of stress concentration on the vane leading and trailing edge corners 48*a*, 48*b*.

Figure 2:
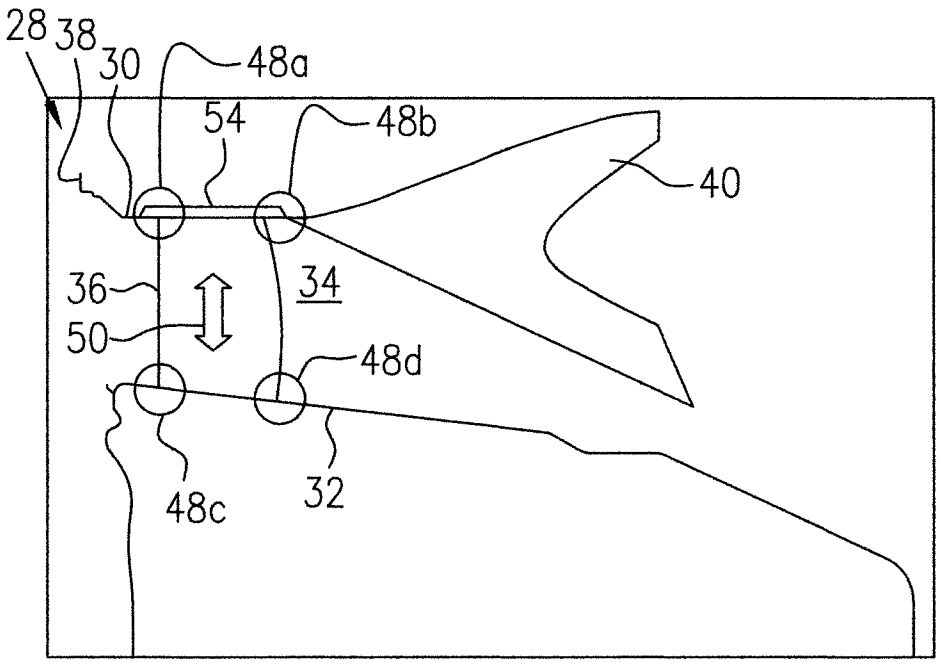
FIG. 2 is a schematic partial cross-sectional view of the engine of FIG. 1, showing a fabricated turbine exhaust case having reinforcing members attached to an outer shroud, according to one embodiment.

Optionally, reinforcing plates 54*a* similar to the reinforcing plates 54 may be attached by welding or brazing to an outer surface (not numbered) of the skin 42*a* of the inner shroud 32 in a manner similar to the attachment of the reinforcing plates 54 to the skin 42 of the outer shroud 30. The outer surface of the skin 42*a* of the inner shroud 32 is the "cold" side of the skin 42*a*, opposite to an inner surface (not numbered) which is the "hot" side of the skin 42*a* of the inner shroud 32. Therefore, the inner surfaces of the respective skins 42 and 42*a* face each other. The reinforcing plates 54*a* are similar, to the reinforcing plates 54 and will not be redundantly described herein. The reinforcing plate 54*a* stiffens the skin 42*a* of the inner shroud 32 at the respective joining areas (not numbered), particularly at the vane leading edge corner 48*c* and vane trailing edge corner 48*b* as shown in FIG. 2, although amplification of stress concentration which particularly occurs at the vane leading and trailing edge corners 48*a*, 48*b* on the outer shroud 30 does not occur at the vane leading and trailing edge corners 48*c*, 48*d* on the inner shroud 32.

The above description is meant to be exemplary only, and one skilled in the art will recognize that changes may be made to the embodiments described without departure from the scope of the described subject matter. For example, the described subject matter is applicable to gas turbine engines other than the exemplary illustrated turbofan engine. The described subject matter is generally applicable to fabricated gas turbine vane structures, but is not limited to the fabricated turbine exhaust case configuration which is disclosed and illustrated as an embodiment of the described subject matter. The described subject matter may be applicable to, for example intermediate case and interturbine vane duct assemblies of gas turbine engines. The reinforcing member may be configured differently from the shape of the described and illustrated reinforcing plates and may include additional features. Still other modifications which fall within the scope of the described subject matter will be apparent to those skilled in the art, in light of a review of this disclosure, and such modifications are intended to fall within the appended claims.

The invention claimed is:

1. A gas turbine engine vane structure comprising:

an annular duct defined between outer and inner shrouds, at least the outer shroud including a single-piece annular skin of sheet metal, the skin having an inner surface exposed to the duct and an outer surface surrounding the duct;

a plurality of circumferentially spaced vanes extending from the inner shroud radially outwardly to a radial outer end which is affixed to the inner surface of the skin by one of welding and brazing;

a plate affixed by one of welding and brazing to the outer surface of the skin at a location corresponding to each vane, the plate having an outer periphery which extends at least on one direction beyond an outer periphery of the respective vane; and wherein at least a number of the plates define two openings which are in fluid communication with a number of the vanes which are hollow, said communication through an opening defined in the skin in a corresponding one of the locations, the two openings separated by a bridge of said plates extending from a pressure side to a suction side of the plate.

2. The vane structure as defined in claim 1 wherein the plate outer periphery is greater than a vane width defined between suction and pressure sides of the radial outer end of the respective vanes.

3. The vane structure as defined in claim 1 wherein the plate outer periphery defines a contacting surface abutting the outer surface of the skin, the contacting surface being greater than a length defined between leading and trailing edges of the radial outer end of the respective vanes.

4. A gas turbine engine vane structure comprising:

an outer shroud and an inner shroud disposed within the outer shroud to define an annular duct extending radially between the outer and inner shrouds, the outer and inner shrouds including a single-piece annular skin of sheet metal, respectively, each of the skins having opposed outer and inner surfaces, the inner surfaces of the respective skins facing each other;

a plurality of circumferentially spaced hollow vanes, each vane extending radially through the annular duct, each hollow vane terminating with a radial inner end on the skin of the inner shroud and terminating with a radial outer end on the skin of the outer shroud, the radial inner and outer ends of each vane being affixed to the skins of the respective inner and outer shrouds by welding or brazing, each of the hollow vanes being in fluid communication with an opening defined in the skin of the respective inner and outer shroud;

a plurality of members having a contacting surface greater than or equal to other individual surfaces of the member, the contacting surface of the members being attached by welding or brazing to the outer surface of the skin of the outer shroud, the contacting surface of each member abutting the skin at a location in which the radial outer end of one of the hollow vanes joins the skin; and wherein each of the members comprises a continuous peripheral portion and a mid portion which in combination define the contacting surface with two openings, the two openings extending through the member being surrounded by the continuous peripheral portion and spaced apart by the mid portion, the two openings being in fluid communication with one of the hollow vanes through a corresponding one of the openings defined in the skin of the outer shroud.

5. The vane structure as defined in claim 4 wherein each of the members covers at least a first portion of the skin of the outer shroud which in combination with one of the vanes defines a vane leading edge corner and a second portion of the skin of the outer shroud which in combination with said one of the vanes defines a vane trailing edge corner.

6. The vane structure as defined in claim 4 wherein each of the members comprises a plate placed flat against the skin of the outer shroud.

7. The vane structure as defined in claim 4 wherein the contacting surface of each of the members has an outer periphery defining an area therein greater than a joining area of the skin defined by a continuous joining line between the skin of the outer shroud and the radial outer end of one of the vanes.

8. The vane structure as defined in claim 4 further comprising additional members similar to said members, the additional members being attached by welding or brazing to an outer surface of the skin of the inner shroud, a contacting surface of each additional member abutting the skin in a location at which the radial inner end of one of the hollow vanes joins the skin.

* * * * *